United States Patent [19]

Cook et al.

[11] Patent Number: 4,596,532

[45] Date of Patent: Jun. 24, 1986

[54] ACTION FIGURE IN WHICH MANIPULATION OF ONE LEG PRODUCES A HORIZONTAL SWINGING OF BOTH ARMS

[75] Inventors: Stuart A. Cook, New Richmond; Phillip G. Reed, Loveland; Michael C. Scarpa, Cincinnati, all of Ohio

[73] Assignee: CPG Products Corp., Minneapolis, Minn.

[21] Appl. No.: 699,620

[22] Filed: Feb. 8, 1985

[51] Int. Cl.[4] ..... A63H 3/20

[52] U.S. Cl. ..... 446/330; 446/334; 446/340; 446/379

[58] Field of Search ..... 446/156, 158, 159, 330, 446/333–336, 340, 341, 352–355, 358, 359, 365

[56] References Cited

U.S. PATENT DOCUMENTS

| | | | |
|---|---|---|---|
| 140,259 | 6/1873 | Eaton | 446/158 |
| 207,188 | 8/1878 | Martin | 446/158 |
| 1,359,778 | 11/1920 | Zimmerman | 446/330 X |
| 1,800,775 | 4/1931 | Bostwick | 446/330 X |
| 2,761,243 | 9/1956 | Baggott . | |

*Primary Examiner*—F. Barry Shay

*Attorney, Agent, or Firm*—Gene O. Enockson; L. MeRoy Lillehaugen; Stuart R. Peterson

[57] ABSTRACT

A toy action figure has its arms mounted for swinging movement about laterally spaced vertical axes, and has one leg mounted for rocking movement toward the figure's other leg. The mounting assembly for each arm includes an arm cup and an arm ball, the arm ball having a crank extending through a horizontal slot in its arm cup. An actuating mechanism interconnects the rockable leg with the two cranks, the actuating mechanism including a transmission link connected at its lower end to the rockable leg so that its upper end, which is forked, acts against an angled cam strip that is part of a lever unit provided with two upstanding pins which project into slots formed in the two cranks.

9 Claims, 13 Drawing Figures

ACTION FIGURE IN WHICH MANIPULATION OF ONE LEG PRODUCES A HORIZONTAL SWINGING OF BOTH ARMS

BACKGROUND OF THE INVENTION

This invention relates generally to toy figures having movable limbs, and pertains more particularly to an action figure in which the manual rocking of one leg in a direction toward the other leg produces a swinging of both arms about generally vertical axes.

SUMMARY OF THE INVENTION

An object of the present invention is to provide a figure in which the arms are swung in a life-like manner about spaced vertical axes, the spaced vertical axes corresponding to the shoulders of the figure. The arm movement is produced by reason of a special type of leg movement, namely, the manipulation of one leg that is mounted for rocking movement in the direction of the figure's other leg. In this way, when the one leg is manually pressed toward the other leg, an actuating mechanism contained within the hollow torso of the toy figure converts the rocking motion via a special type of cam action to a motion that results in a swinging of the figure's arms from a more rearwardly disposed position into a more forwardly disposed position. More specifically, the hands at the lower ends of the arms traverse an arcuate path, moving from a laterally spaced relationship with respect to the sides of the torso into a closer relationship with each other which is more to the front of the torso.

Another object of the invention is to provide a toy of the foregoing type that can be manipulated by children of virtually all ages. In this regard, an aim of the invention is to provide a toy that will prove of interest to most children, especially those of rather tender age inasmuch as the manipulation of the one leg that produces the swinging arm movement is easily achieved. It is also within the purview of the invention to have the one leg, as well as the two arms, return to their unactuated positions when the child ceases to apply a manipulation force to the one leg, the limb return being through the agency of a spring contained within the hollow torso.

Another object is to provide a toy figure that can be manufactured at a relatively low cost. In this respect, it is planned that the mechanism for transmitting the leg movement to the arms be of relatively simply construction.

A further object is to have the mechanism for converting the leg movement to the swinging-type arm movement contained completely within the toy's torso.

Yet another object of the invention is to provide a toy action figure that will simulate the limb movements of a well-known comic character, thereby increasing the amount of appeal the toy possesses.

Briefly, the present invention is comprised of a three dimensional figure having a hollow torso in which the actuating mechanism is housed. Each of the two arms is mounted for swinging movement about a generally vertical axis when the toy figure is upright. The mounting assembly for each of the arms includes an arm cup or socket in which an arm ball is constrained so that the arm ball swivels or swings about a vertical axis. Each arm cup is formed with a horizontal slot that is integral with the arm cup with which it is associated and through which extends a crank member having a slot therein.

The actuating mechanism for the arms includes a pair of pins projecting upwardly into the slots in the cranks to produce the swinging movement. Depending downwardly from the pins are vertical legs having cylindrical bearings issuing in opposite directions. The bearings are journaled for rotation in notches formed in the rear shell constituting the torso. The pins and vertical legs are connected with each other by means of a bridging strip having cam surfaces or edges on each side thereof. The cam strip extends in an angled direction so that a saw-tooth-like appearance is imparted to the overall lever arrangement that includes the upstanding pins and the oppositely issuing cylindrical bearings.

The actuating mechanism additionally includes a transmission link having a bifurcated or forked upper end forming an upwardly directed notch that receives the bridging strip therein so that when the transmission link is rocked it will cause the tines or fingers of the forked end to bear against the opposite sides of the bridging strip, thereby producing a camming action that is transmitted through the cranks to swing the arms about their respective vertical axes. The transmission link includes a flat vertical shank or strip and at the lower end of the shank is a leg mounting unit onto which is snapped the thigh of the leg to be manipulated. It is the manual pressing or rocking of this leg in the direction of the other leg that causes the arms to swing. Whenever the child releases his or her grip on the leg that has been actuated to cause the arms to swing, a spring returns the arms and that leg to their normal unactuated position.

DESCRIPTION OF THE PREFERED EMBODIMENT

Figure 10:
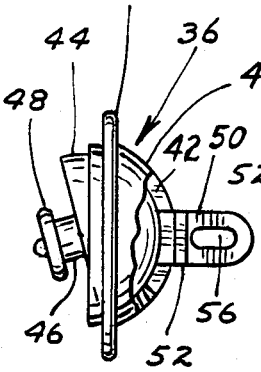
FIG. 10 is a rear elevational view of the mounting assembly for the left arm, the assembly having been removed from the torso.

The action figure selected for the purpose of illustrating our invention has been denoted generally by the reference numeral 10 and includes a head 12 and a hollow torso 14, the torso 14 being comprised of two plastic shells suitably secured together. Additionally, the FIG. 10 includes a left arm 16, a right arm 18, each arm having a hand 20 at its lower end. Still further, the FIG. 10 is provided with a left leg 22 and a right leg 24, each leg having a knee 26 and foot 28. Although not relevant to the instant invention, the knee 26 in each instance permits the leg 22 or the leg 24 to flex in order to resemble an actual knee movement.

Figure 2:
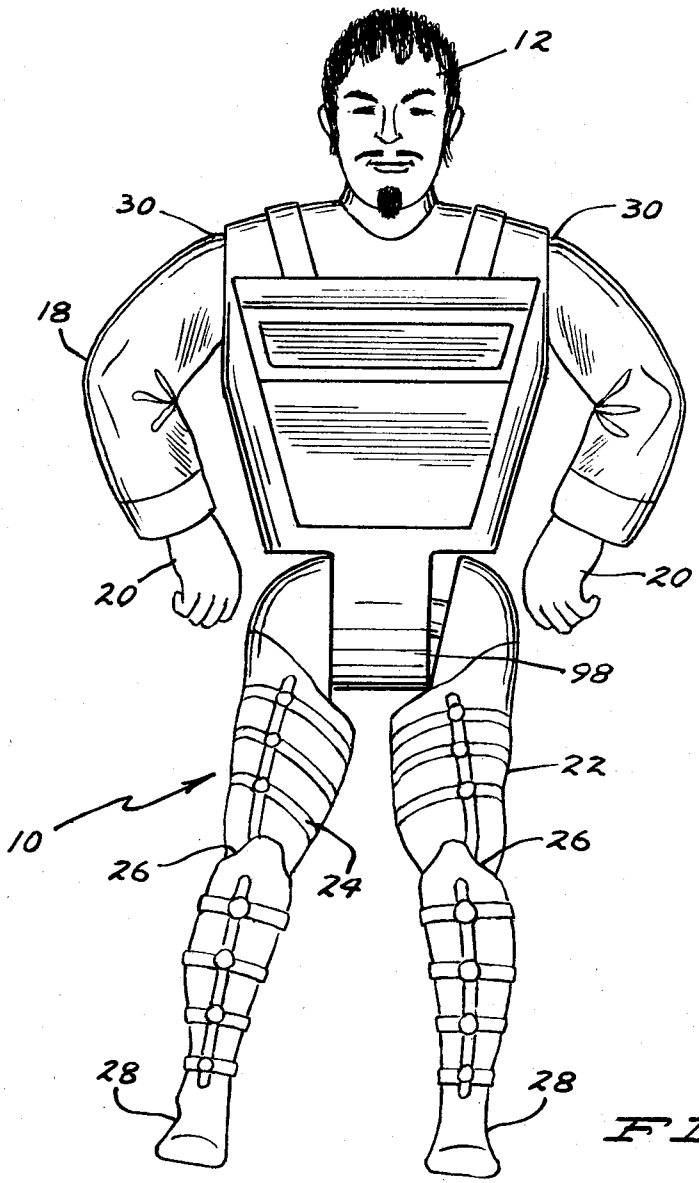
FIG. 2 is also a front elevational view but with the left leg actuated or pressed toward the right leg to swing the figure's arms forwardly.
Figure 1:
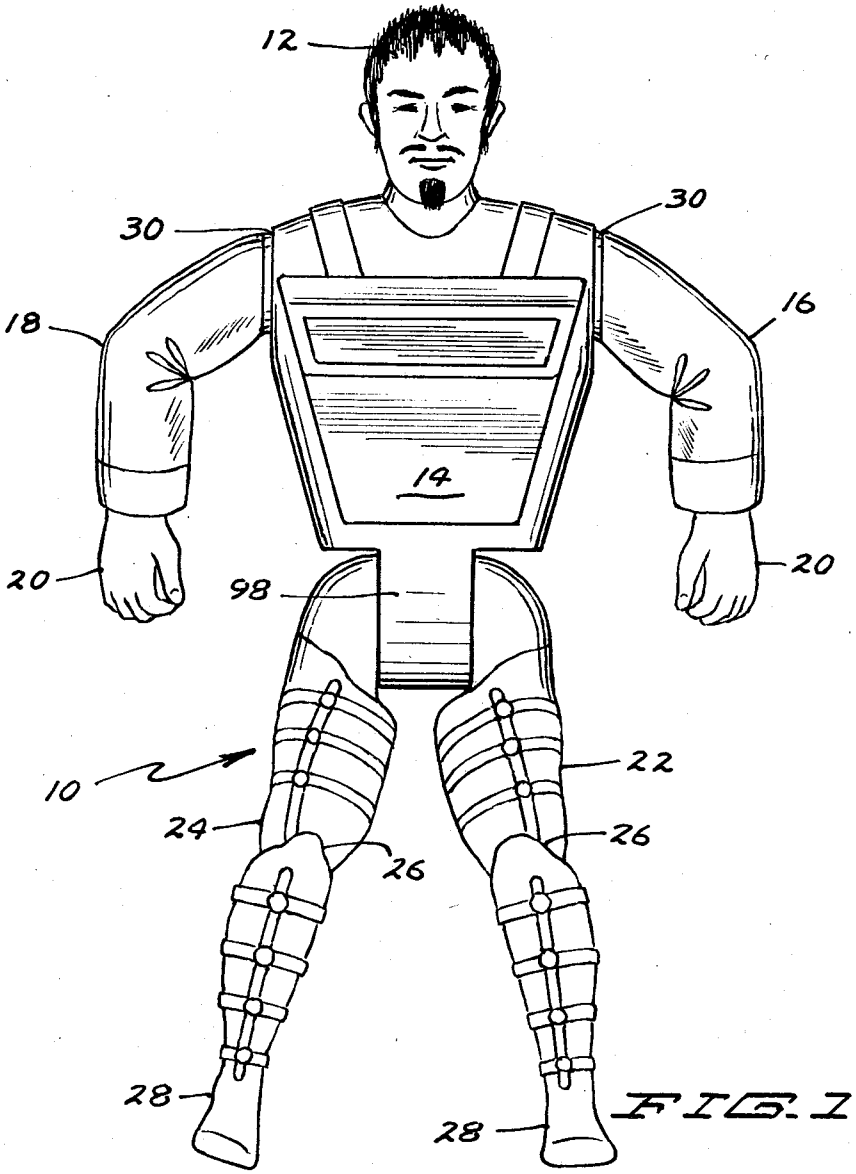
FIG. 1 is a front elevational view of an action figure exemplifying the invention with the left leg being unactuated and hence with the arms also unactuated.

It is planned that both arms 16 and 18 be mounted so as to pivot or swivel about laterally spaced vertical axes, doing so from a position in which the hands 20 are spaced laterally from the sides of the torso 14, as can be perceived in FIG. 1, to a more forwardly located position in which the hands 20 are closer together, as can be discerned in FIG. 2. Although other views aptly portray the arm movement, special attention perhaps should be given at this stage to FIGS. 6 and 7, even though these two figures are fragmentary sectional views; nonetheless, they show to good advantage the swinging movement that has just been described.

The shoulder or upper end of each arm has been given the reference numeral 30. The upper ends of the arms 16, 18 each contain a socket 32. All that need be understood at the moment is that the respective sockets 32 releasably anchor or attach the arms 16 and 18 to an arm mounting assembly denoted generally by the reference numeral 36 which will now be referred to in detail.

Figure 12:
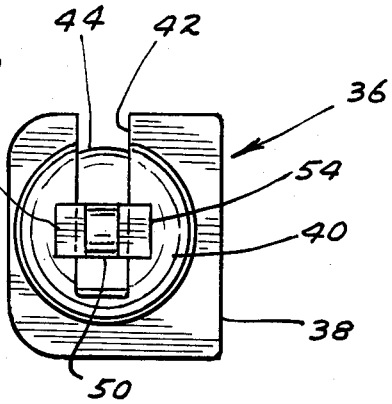
FIG. 12 is a view taken from the right of FIG. 10.
Figure 13:
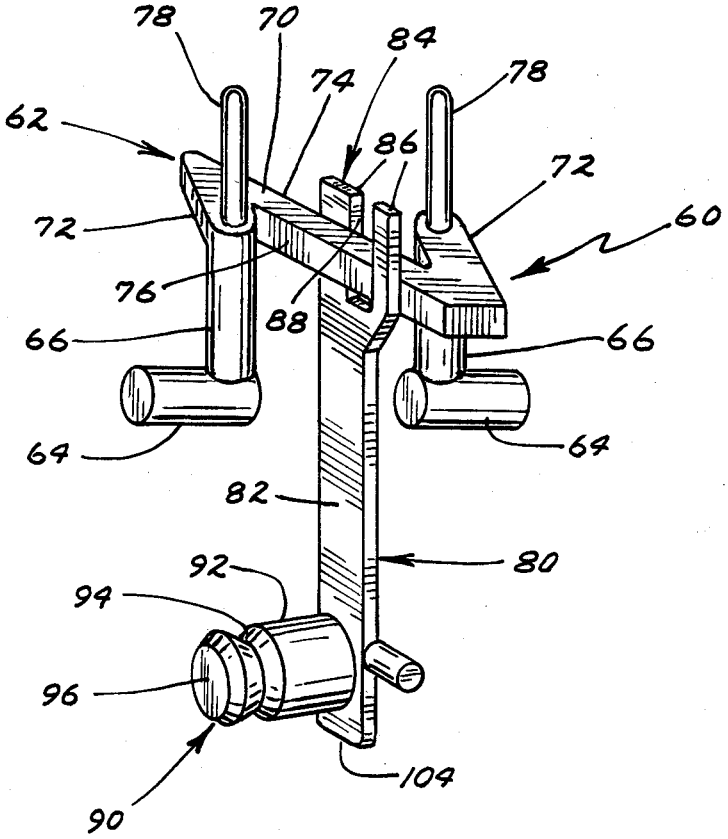
FIG. 13 is a perspective view of the actuating mechanism in its unactuated condition, the mechanism having been completely removed from the torso.

The construction of one of the two arm mounting assemblies 36 will now be described, and it should be appreciated that the two assemblies 36 are mirror images of each other. As can perhaps be best understood from FIG. 10, the particular mounting assembly 36 there appearing includes a flange 38 that has a thickness corresponding to the width of a groove 39 formed in the torso 14. Integral with the flange 38 is an arm cup 40 that physically constitutes a semi-spherical socket. There is a horizontal slot 42 that extends forwardly as far as the mounting assembly 36 at the left is concerned, and extends rearwardly as far as the mounting assembly 36 at the right is concerned. Additionally included in each mounting assembly 36 is an arm ball 44, actually a semi-spherical ball, having a short cylindrical shank 46 projecting from the flat side thereof. At the free end of the shank 46 is a flange 48 of a size such that it can be press-fitted into the previously mentioned socket 32 formed in the upper end of the arm 16. Whereas the shank 46 projects from one side of the arm ball 44, a crank 50 projects from the other or round side. The crank 50 has a pair of ears 52, 54 integral therewith, the ear 52 projecting upwardly and the ear 54 projecting downwardly. From FIG. 12 it can be understood that the ears 52, 54 confront one side of the arm cup 40, whereas the arm ball 44 confronts the other side of the cup 40. In this way, the arm ball 44 is constrained to pivot or swivel about a vertical axis. The crank 50 also has a slot 56 formed therein for a purpose presently to be explained.

Playing an important role in the practicing of our invention is an actuating mechanism indicated generally by the reference numeral 60. Included in the mechanism 60 is a sawtooth-like lever unit 62 having a pair of cylindrical bearings 64 issuing outwardly from the lower ends of a pair of laterally spaced vertical leg members 66. The cylindrical bearings 64 are received in forwardly facing notches 68 formed in the rear shell portion of the torso 14, the front portion, when the two shells are assembled, holding the bearings 64 captive in their respective notches 68. The lever unit 62 further comprises a cam strip 70 having end portions 72 integral with the upper ends of the vertical legs 66. The cam strip 70 extends at an angle, when viewed from above, between the two end portions 72, thereby imparting a sawtooth appearance to the lever unit 62. In this way, front and rear cam edges 74 and 76 are provided which are acted upon in a manner presently to be described. At this time, though, cognizance should be taken of the employment of a pair of upstanding pins 78, the pins 78 extending upwardly from the legs 66 and the end portions 72 through the previously mentioned slots 56 in the cranks 50.

Continuing with the description of the actuating mechanism 60, the mechanism includes a transmission link 80 having a straight flat shank 82 provided with a bifurcated or forked upper end 84 formed by spaced fingers 86 to provide an upwardly directed notch 88 that receives therein the cam strip 70. The lower end of the transmission link 80 is formed with an integral leg mounting unit 90 having a sleeve or cylindrical portion 92 extending from one side of the flat shank 82, the sleeve or cylindrical portion 92 having a circumferentially disposed groove 94 near its free end, thereby forming, in effect, a head 96.

The lower or crotch portion of the torso 14 has been labelled 98. It possesses a rectangular or U-shaped appearance, as can be seen in FIGS. 1, 2, 3, and 4. From FIGS. 3 and 4, it will be noted that a notch 100 is formed which has a horizontal base or bight 102. The base 102 provides a rocking axis 104 for the rounded lower end of the transmission link 80.

Whereas the left leg 22 is formed with a socket 106 into which can be snapped the head 96, the right leg 24, which need only swing forwardly and rearwardly and not inwardly as does the leg 22, is provided with a mounting unit 108 having a sleeve or cylindrical portion 110 formed with a flange 112. Being conventional, it is not believed necessary to break away any portion of the thigh involving the connection of the right leg 24, but one can see from FIGS. 3 and 4 that there is a leg clip 114 that is imbedded, as shown in the drawings, within the thigh portion of the right leg 24. The upper end of the leg clip 114 is apertured so as to receive therein a head (not visible) that is an integral part of the mounting unit 108. In practice, both legs 22 and 24 would be hollow shells, and so would the two arms 16 and 18; however, for the sake of convenient illustration, these limbs have been shown as being molded in the form of a solid plastic.

Figure 8:
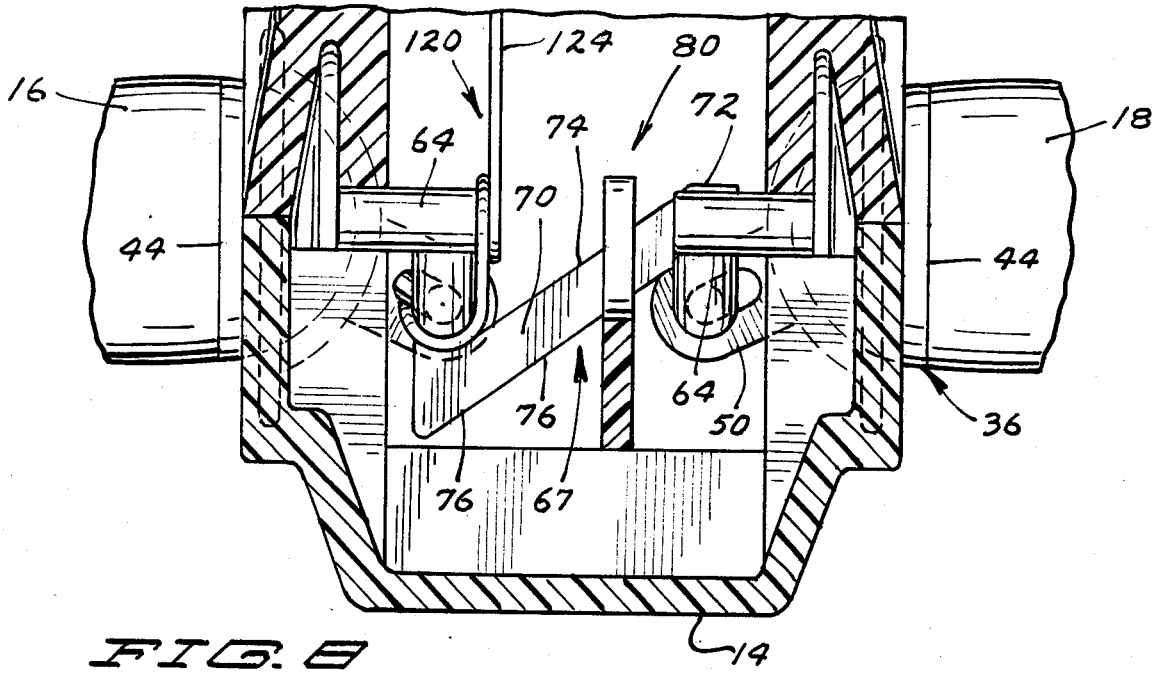
FIG. 8 is a sectional view taken in the direction of line 8—8 of FIG. 3, the view showing the bottom of the actuating mechanism.
Figure 9:
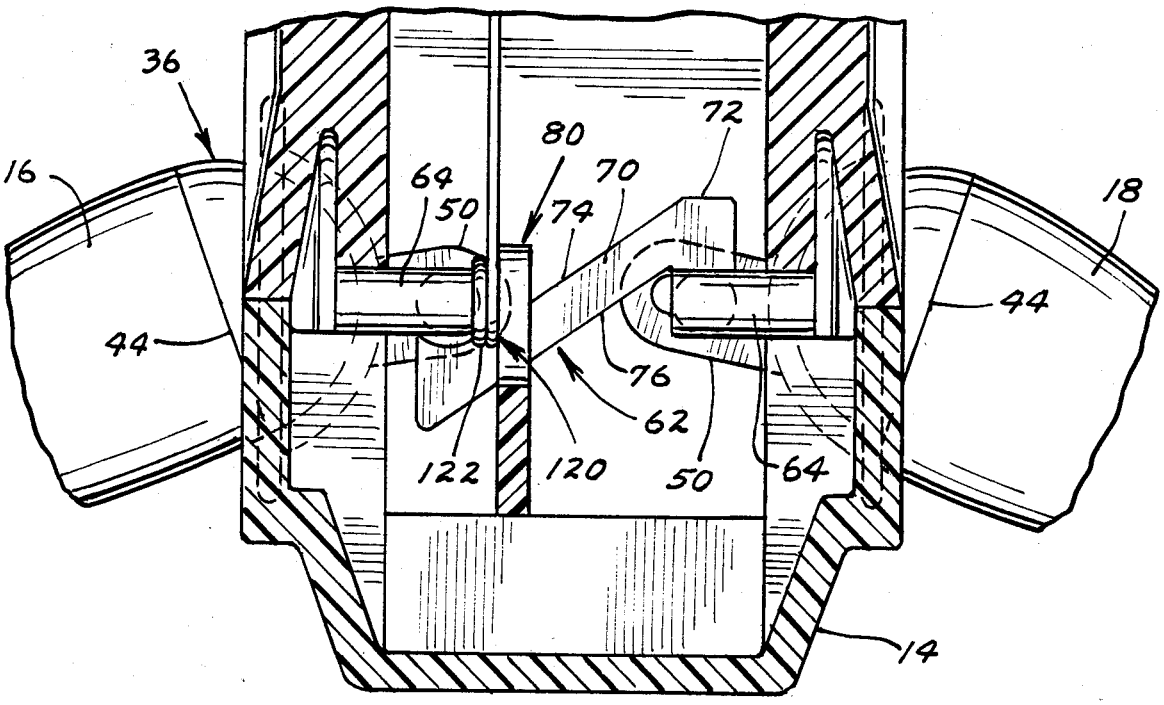
FIG. 9 is a view taken in the direction of line 9—9 of FIG. 4 for the purpose of showing the actuating mechanism in its actuated or manipulation condition.
Figure 11:
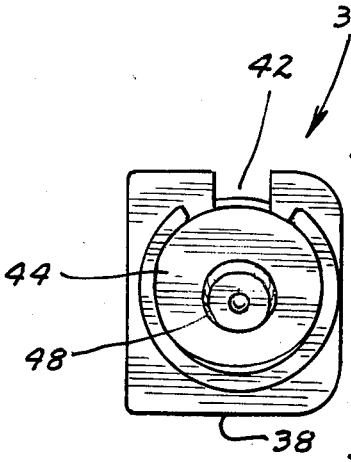
FIG. 11 is a view taken from the left of FIG. 10.

It will be recognized that the left leg 22 is normally vertical or parallel with respect to the right leg 24. This normal or unactuated condition of the left leg 22 appears in FIGS. 1 and 3, whereas the normal or unactuated condition of the arms appears in these two views, as well as in FIGS. 6 and 8. The unactuated condition of the arms 16, 18 and the leg 22 is established by a return spring labeled 120 that has a coiled central portion 122 and end portions 124 and 126. From FIGS. 3 and 4, it will be observed that the end portion 124 encircles one of the members 66 belonging to the lever unit 62, whereas the other end portion 126 is straight, reactively engaging the rear of the torso 14, as can be seen in FIGS. 5, 8, and 9. In this way, the coil spring 120 biases the actuating mechanism 60 in a direction so that the arms 16, 18 and leg 22 return to their normal or inactive positions as illustrated in FIGS. 1, 3, 6, and 8. As can be discerned from FIGS. 2 and 4, when the left leg 22 is manually pressed twoard the right leg 24, a notch or gap 128 is formed with respect to the left side of the lower or crotch portion 98.

Figure 3:
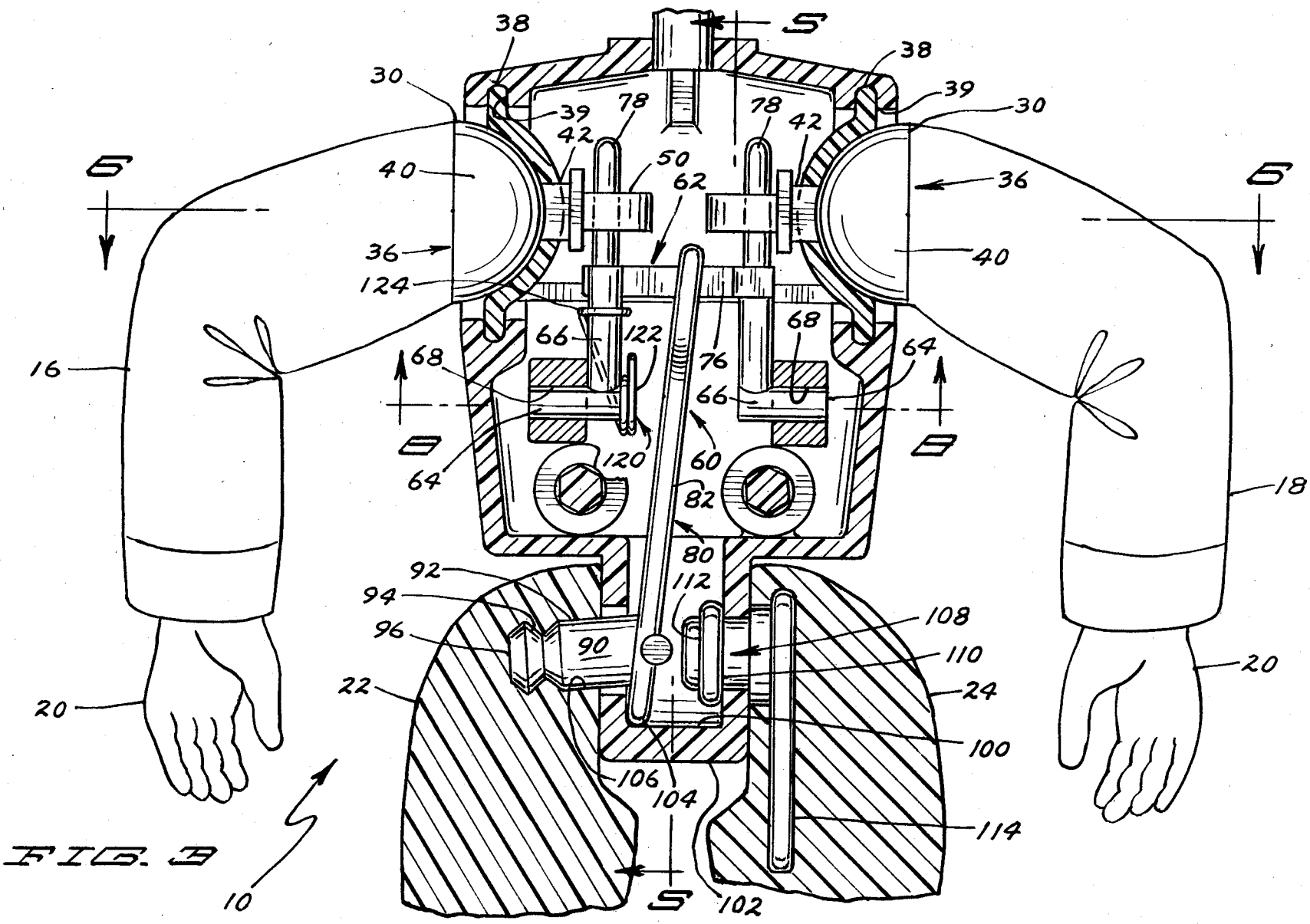
FIG. 3 is a sectional view taken in the direction of line 3—3 of FIG. 5, which is actually a view from the rear with the back of the torso omitted.
Figure 4:
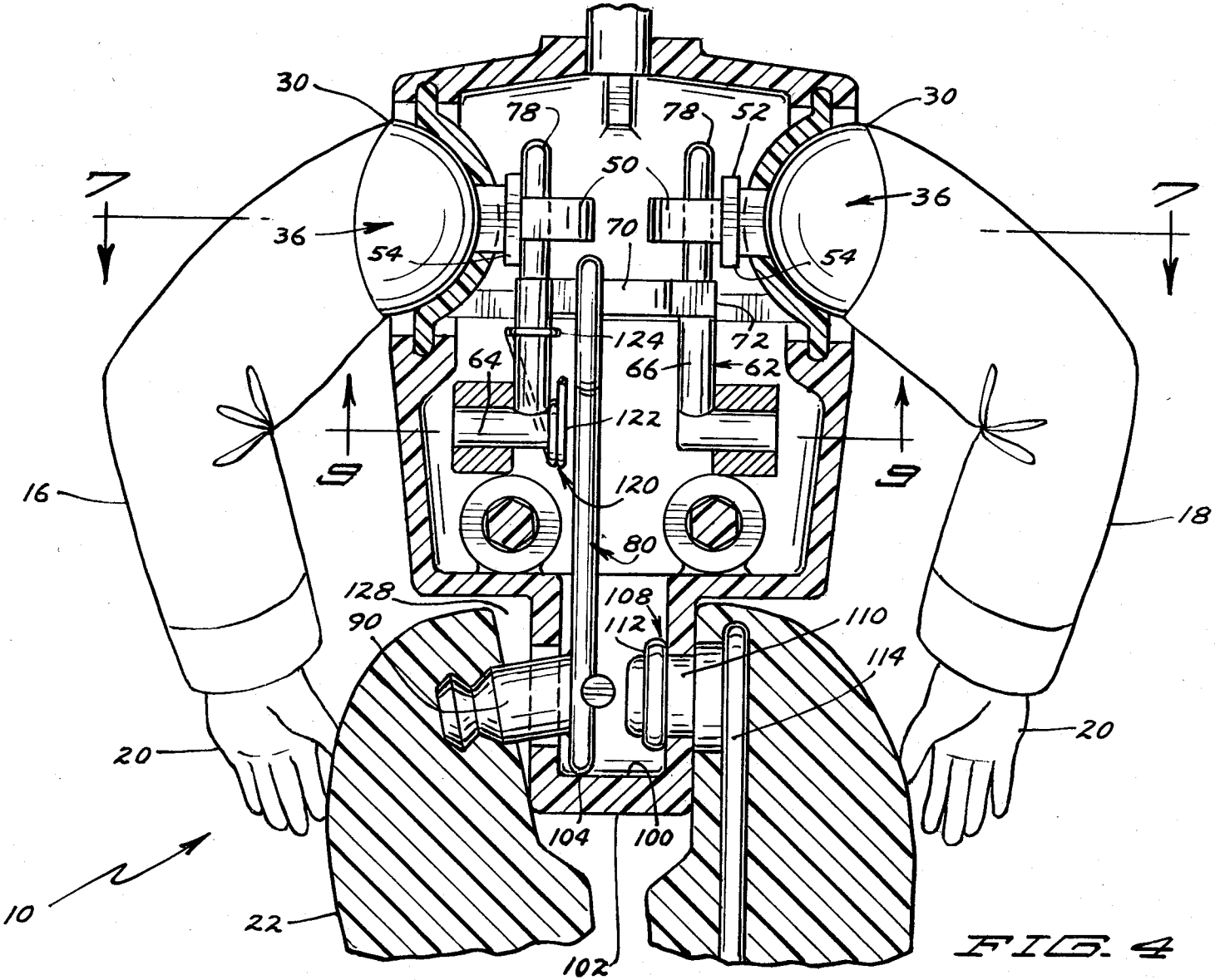
FIG. 4 is a sectional view corresponding to FIG. 3 but with the leg and arms in their actuated condition as in FIG. 2.
Figure 5:
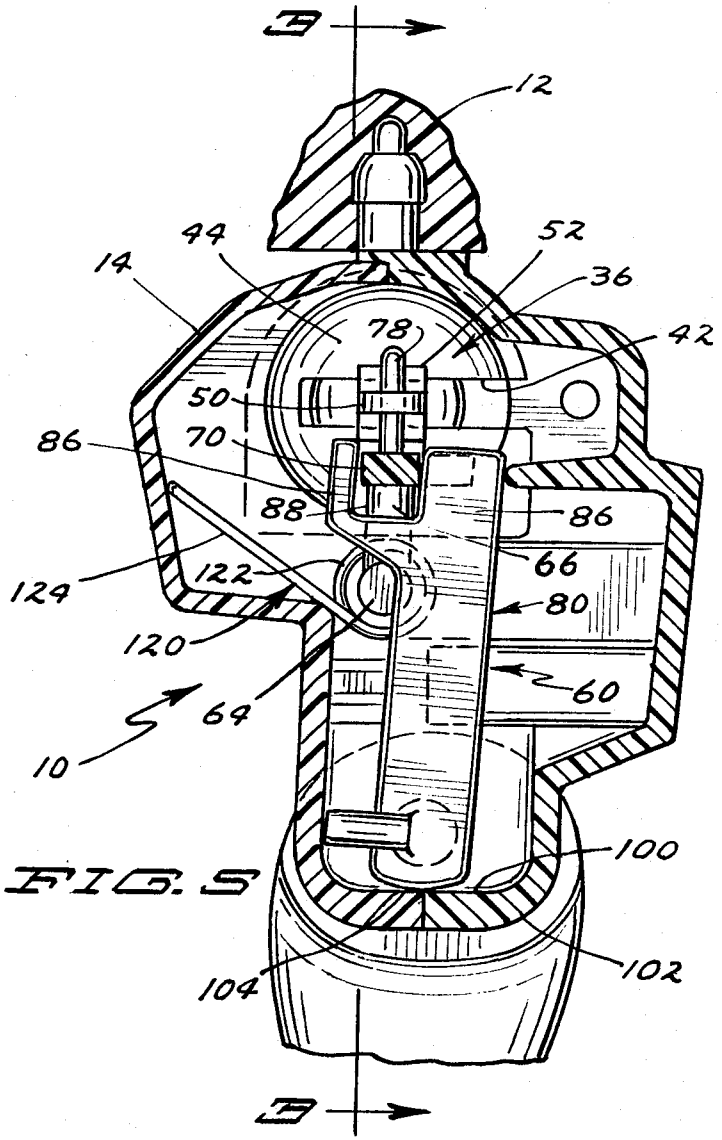
FIG. 5 is a sectional view taken in the direction of line 5—5 of FIG. 3.

In operation, when the left leg 22 is manually pressed inwardly toward the right leg 24, the notch 128 appears as is evident from FIGS. 2 and 4. The rocking of the left leg 22 causes the transmission link 80 to rock in a counterclockwise direction as viewed in FIG. 3, the rocking motion causing the bifurcated or forked upper end 84 on the link 80 to move to the left. The left position of the forked end 84 is clearly visible in FIG. 4. It might be well, though, to refer to FIGS. 6 and 7 at this time, because these two figures depict the movement of the upper end 84 from the right (FIG. 6) to the left (FIG. 7). It is during the movement of the upper end 84 of the link 80 that the fingers 86 constituting the bifurcated end 84 ride against the opposite edges of the cam strip 70. In this way, owing to the fact that the bifurcated end 84 provides the notch 88 that receives the strip 70 therein, a camming of the lever unit 62 results which causes the cylindrical bearings 64 to partially rotate in the two notches 68 in which they reside. This motion, of course, is transmitted to the slotted cranks 50 by means of the upwardly directed pins 78. It will be easily recognized from FIGS. 6 and 7 that the upwardly directed pins 78 extend into the slots 56; this relationship can also be seen in FIGS. 3 and 4.

Figure 6:
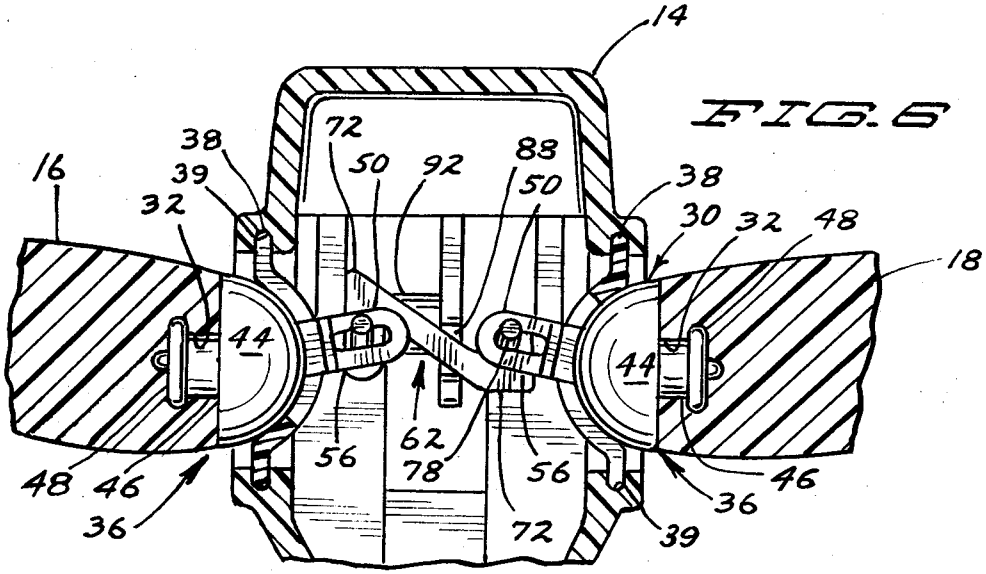
FIG. 6 is a horizontal sectional view taken in the direction of line 6—6 of FIG. 3, the view looking down on the actuating mechanism.
Figure 7:
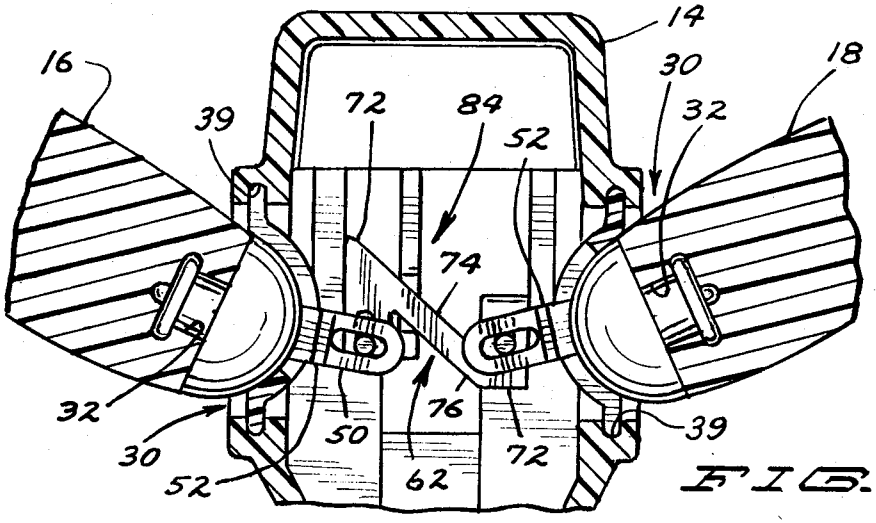
FIG. 7 is a sectional view corresponding to FIG. 6 but showing the arms swung forwardly, the position of the arms thus corresponding to the arm relationship depicted in FIG. 4.

What occurs is that the movement of the pins 78 from a more forwardly disposed position, as in FIG. 6, to a more rearwardly disposed location, as is evident in FIG. 7, causes the arms 16 and 18 to pivot about the vertical axes provided by the mounting assemblies 36, more specifically by the interfitting arm cups 40 and the arm balls 44. It will be appreciated that the ears 52, 54 that extend upwardly and downwardly, respectively, from the cranks 50 confine and hold the arm balls 44 in a nestled relation with the arm cups 40. In other words, there is provided a ball and socket joint effect that enables the arms 16 and 18 to be swung forwardly. As this occurs, the hands 20 at the lower ends of the arms 16, 18 traverse an arc that starts abreast of the thighs of the action FIG. 10, the hands 20 moving in arcuate paths forwardly and toward each other, as is believed is understandable from FIGS. 1 and 2, as well as FIGS. 3 and 4.

When the child relinquishes his or her manipulation force, the spring 120 causes the leg 22, which has been pressed toward the leg 24, to return to its initial or unactuated position, as illustrated in FIGS. 1 and 3. Concomitantly, the fingers 86 ride back along the edges 74 and 76 on the cam strip 70 to cause the arms 16 and 18 to swing rearwardly, the more rearward positions of the arms 16, 18 appearing in FIGS. 1, 3, and 6. In other words, the entire actuating mechanism 60 is returned to its original or unactuated condition via the spring 120.

It will be understood that the word "vertical" in referring to the axes about which the arms 16 and 18 pivot, as provided by the mounting assemblies 36, is when the toy action FIG. 10 is vertical, as in FIGS. 1–4. In general, the referred to pivot axes, or axis if referred to in the singular, are parallel, or substantially so, to the longitudinal axis of the FIG. 10, that is, a line passing centrally through the hand 12, the torso 14 and the lower or crotch portion 98 of the torso 14.

We claim:

1. A toy action figure comprising a hollow torso, first and second arms, each having a hand at the lower end thereof, first means mounting the upper end of said first arm to said torso at one side thereof for swinging movement about a generally vertical axis so that its hand traverses a forwardly advancing arcuate path, a crank member extending horizontally into said torso from said first arm, first and second legs, means mounting the upper end of said first leg to said torso for rocking movement toward said second leg, and actuating means within said figure interconnecting said first leg with said first arm to produce said swinging movement of said first arm to cause its hand to traverse said arcuate path, said actuating means including a transmission link connected at its lower end to the upper end of said first leg for rocking movement therewith, a generally horizontal angled cam strip movably mounted in said torso for producing the swinging movement of said first arm when said cam strip is moved, means at the upper end of said transmission link integral with said transmission link and movable along said angled cam strip for acting on said cam strip to move said cam strip when said first leg is rocked, and means on said angled cam strip for acting against said crank member to produce said swinging movement of said first arm.

2. A toy action figure in accordance with claim 1 including second means mounting the upper end of said second arm on said torso at the other side thereof for swinging movement about a second generally vertical axis so that its hand traverses a second forwardly advancing arcuate path to move said hands closer to each other, a second crank member extending horizontally into said torso from said second arm, and additional means on said angled cam strip for acting against said second crank member to produce said swinging movement of said second arm to cause its hand to traverse said second arcuate path.

3. A toy action figure comprising a hollow torso, first and second arms, each having a hand at the lower end thereof, first means mounting the upper end of said first arm to said torso at one side thereof for swinging movement about a generally vertical axis so that its hand traverses a forwardly advancing arcuate path, second means mounting the upper end of said second arm on said torso at the other side thereof for swinging movement about a second generally vertical axis so that its hand traverses a second forwardly advancing arcuate path to move said hands closer to each other, first and second legs, means mounting the upper end of said first leg to said torso for rocking movement toward said second leg, actuating means interconnecting said first leg with said arms, said actuating means including a transmission link connected at its lower end to the upper end of said first leg for rocking movement therewith and having a pair of fingers at its upper end forming a notch therebetween, an angled cam strip for producing the swinging movement of said arms when said cam strip is moved, said cam strip residing in said notch and acted on by said fingers ehen said transmission link is rocked by said first leg, and a pair of pins at the ends of said cam strip for connecting said cam strip to said first and second means for producing said swinging movement of said arms when said cam strip is moved by said fingers.

4. A toy action figure in accordance with claim 1 in which said first and second arm-mounting means each includes a fixedly disposed arm cup and an arm ball movable therein, a crank integral with the curved side of each arm ball, said cranks having slots therein and said pins projecting into said slots to effect the swinging movement of said arms.

5. A toy action figure in accordance with claim 4 in which each of said arm cups have horizontal slots through which said cranks extend.

6. A toy action figure in accordance with claim 5 including at least one ear on each of said cranks in engagement with a convex side of said arm cup to constrain each of said arm balls for swinging movement about said vertical axes.

7. A toy action figure comprising a hollow torso, first and second arms, each having a hand at the lower end thereof, a mounting assembly attaching the upper end of each arm to said torso for swinging movement about generally vertical, laterally spaced axes, each of said mounting assemblies including an inwardly directed crank, first and second legs mounted on and extending downwardly from said torso, means mounting said first leg for rocking movement with respect to said torso toward said second leg, and an actuating mechanism in said figure interconnecting said first leg to said arms via said cranks to produce said swinging movement of said arms, said actuating mechanism including a transmission link connected at its lower end to said first leg for rocking movement therewith and including a level unit having generally horizontal angled and laterally spaced cam edges, the upper end of said transmission link having means for acting on both of said angled cam edges so that movement of said first leg is transmitted via said link and lever unit to said cranks to produce swinging movement of said arms in opposite directions about said vertical axes.

8. A toy action figure comprising a hollow torso, first and second arms, each having a hand at the lower end thereof, a mounting assembly for attaching the upper end of each arm to said torso for swinging movement about generally vertical, laterally spaced axes, each of said mounting assemblies including an inwardly directed crank, first and second legs extending downwardly from said torso, means mounting said first leg for rocking movement toward said second leg, and an actuating mechanism interconnecting said first leg to said arms via said cranks to produce said swinging movement of said arms, said actuating mechanism including a transmission link connected at its lower end to said first leg and including a lever unit having angled cam edges acted on by the upper end of said transmission link so that movement of said first leg is transmitted via said link and lever unit to said cranks, said lever unit including a pair of cylindrical bearings journaled for at least partial rotation within said torso, a pair of leg members extending upwardly from said bearings, an angled cam strip at the upper ends of said leg members, said strip providing said angled cam edges, and a pair of pins projecting upwardly from the ends of said cam strip, each said crank having a slot therein into which a respective one of said pins extends.

9. A toy action figure in accordance with claim 8 in which the upper end of said transmission link has a pair of upwardly directed fingers forming a notch therebetween, said angled cam strip being received in said notch so that said fingers act against said cam edges to cause said pins to angularly shift said cranks and to swing said arms about said vertical axes.

* * * * *